US005350160A

United States Patent [19]

Crafton et al.

[11] Patent Number: 5,350,160

[45] Date of Patent: Sep. 27, 1994

[54] METHOD AND APPARATUS FOR HEAT TREATING METAL CASTINGS

[75] Inventors: Paul M. Crafton, Marietta; Scott P. Crafton, Kennesaw, both of Ga.

[73] Assignee: Consolidated Engineering Company, Kennesaw, Ga.

[21] Appl. No.: 149,323

[22] Filed: Nov. 9, 1993

Related U.S. Application Data

[60] Division of Ser. No. 979,621, Nov. 20, 1992, Pat. No. 5,294,094, which is a continuation of Ser. No. 705,626, May 24, 1991, abandoned, which is a continuation-in-part of Ser. No. 415,135, Sep. 29, 1989, abandoned.

[51] Int. Cl.[5] ..... B22D 29/00

[52] U.S. Cl. ..... 266/252; 164/269

[58] Field of Search ..... 266/249, 252, 44; 148/538, 547, 548; 164/269, 270.1

[56] References Cited

U.S. PATENT DOCUMENTS

| | | | |
|---|---|---|---|
| 2,385,962 | 10/1945 | Barnett | 266/252 |
| 2,988,351 | 6/1961 | Barnett et al. | 266/252 |
| 3,871,438 | 3/1975 | Vissers et al. | 164/5 |
| 4,211,274 | 7/1980 | Slowinski et al. | 164/401 |
| 4,411,709 | 10/1983 | Nakanishi | 148/3 |
| 4,415,444 | 11/1983 | Guptail | 164/269 |
| 4,544,013 | 10/1985 | Kearney | 164/5 |
| 4,577,671 | 3/1986 | Stephan | 164/401 |
| 4,582,301 | 4/1986 | Wunning | 266/252 |
| 4,955,425 | 9/1990 | McKenna | 164/270.1 |

FOREIGN PATENT DOCUMENTS

| | | | |
|---|---|---|---|
| 2307773 | 2/1973 | Fed. Rep. of Germany . | |
| 3206048 | 2/1982 | Fed. Rep. of Germany . | |
| 56-53867 | 5/1981 | Japan . | |
| 58-25860 | 2/1983 | Japan . | |
| 59-219410 | 12/1984 | Japan . | |
| 0092040 | 5/1985 | Japan | 164/132 |
| 2074022 | 4/1987 | Japan | 266/252 |
| 0016853 | 1/1988 | Japan | 164/132 |
| 0234810 | 4/1986 | U.S.S.R. | 164/132 |
| 2230720 | 10/1990 | United Kingdom . | |

OTHER PUBLICATIONS

Paper work describing Beardsley & Piper PNEU-Reclaim Sand Reclamation Units Sep. 1988.

Paperwork describing Fataluminum Sand Reclamation Units Sep. 1988.

Preliminary Remarks dated Jul. 30, 1991 (filed originally in application Ser. No. 07/705,626).

Declaration by P. M. Crafton and S. P. Crafton dated Jul. 26, 1991 (filed originally in application Ser. No. 07/705,626).

Paul M. Crafton; Heat Treating Aging System Also Permits Core Sand Removal; reprinted from Sep. 1989 Modern Casting Magazine.

*Primary Examiner*—Scott Kastler

*Attorney, Agent, or Firm*—Louis T. Isaf

[57] ABSTRACT

An improved method and apparatus for heat treating metal castings with sand cores provides for removal of the sand core and recovery of the sand core material for reuse. The method and apparatus eliminate the need for removing the sand core from the casting prior to heat treatment and thus eliminate the labor, expense, and possible damage to the casting incidental to conventional core removal techniques such as chiseling and shaking. The method involves heating the casting with sand core therein to a temperature sufficient to burn off the binder component of the sand core. The sand comprising the sand core is then blown out of the casting by directing a flow of air over the workpiece. The sand thus dislodged is then collected for reuse. According to the disclosed apparatus, the castings are heated in a furnace having fans for directing a flow of air over the workpieces. The sand dislodged from the castings falls into a trough in the lower portion of the furnace, where it is collected and conveyed to a central collection bin for reuse. In another aspect of the disclosed apparatus, the castings are subsequently immersed in a quench tank. The quench tank includes agitation means for agitating water over the castings to dislodge remaining sand. The sand falls to the bottom of the tank, where the sand and a portion of the water are removed from the tank. A major portion of the water is then removed from the sand so that the sand can be reused.

5 Claims, 6 Drawing Sheets

13
85
96
96
90
92
86
88
94
98

METHOD AND APPARATUS FOR HEAT TREATING METAL CASTINGS

CROSS REFERENCE TO RELATED APPLICATIONS

This application is a division, of application Ser. No. 07/979,621, filed on Nov. 20, 1992 now U.S. Pat. No. 5,294,094 which is a continuation of application Ser. No. 07/705,626, filed on May 24, 1991, allowed on Sep. 22, 1992, and now abandoned, which was a continuation-in-part of application Ser. No. 07/415,135, filed on Sep. 29, 1989 and now abandoned.

TECHNICAL FIELD

The present invention relates generally to methods and apparatus for heat treating hollow metal castings, and relates more specifically to an improved method and apparatus for heat treating metal castings with sand cores which provides for removal of the sand core and for recovery of the sand core material for reuse.

BACKGROUND OF THE INVENTION

Methods and apparatus for manufacturing hollow metal castings such as cylinder heads, engine blocks, and the like are well known. Conventional prior art processes for manufacturing aluminum castings typically employ a cast iron "flask-type" mold having the exterior features of the block formed on the interior walls of the mold. A sand cover, premolded from a mixture of sand and an organic binder and having interior features of the casting formed on by its exterior surface, is placed within the mold. The mold is then filled with molten aluminum alloy.

After the aluminum alloy has solidified, the casting is removed from the mold. Because untreated aluminum alloys may be softer or less strong than desired, it is often necessary to heat treat the casting to strengthen or harden the metal. According to conventional manufacturing processes, before the casting is heat treated, the sand is removed from the interior of the casting. An operator chisels the sand out of the interior of the workpiece with a pneumatic chisel. The casing may then be fed into a "shakeout" system, a vibrating table which agitates the casting to further break up the sand and dislodge it from the interior of the casting. When the sand has been removed, the casting is heat-treated in a conventional manner by heating the casting to a high temperature and then quenching the casting. Optionally, the casting may further be heated at a lower temperature to "age" the aluminum alloy.

If it is then desired to recover the sand removed from the interior of the casting for subsequent reuse, additional steps must be taken to process the sand. The sand removed by chiseling and shaking the casting is fed into a sand burnout unit to burn off the binders.

Prior art processes for manufacturing aluminum alloy casting suffer a number of disadvantages. The steps of removing the sand from the interior of the casting by chiseling and shaking not infrequently result in damage or scarring to the as-then unhardened aluminum alloy. Further, the shakout process must be carried out manually and is thus labor-intensive, thereby increasing the expense of the manufacturing process. Also, the additional steps required to salvage the sand for reuse are time-consuming and require additional labor and equipment expense. The sand recovery process is costly and presents certain environmental problems concerning the handling of the binder waste products.

Efforts have been made to overcome some of the disadvantages associated with prior art methods and apparatus for sand-casting metal objects. One example is disclosed in U.S. Pat. No. 4,411,709, wherein a method for the manufacture of aluminum alloy castings comprises pouring a molten aluminum alloy into a mold having therein a sand core formed from sand and an organic resin binder. After the alloy solidifies, the casting is shaken or vibrated to destroy the core, and approximately half of the sand used to form the core can readily be removed from the casting. Subsequently, the casting is heated, and the organic resin binder in the remaining portion of the sand core is burned off. The sand is thus unbonded such that about 80% of the remaining sand (approximately 40% of the total core sand) falls from the casting by force of gravity. Thereafter, the casting is quenched in a water bath, and the remaining sand in the casting is removed by flowing water through the casting.

While the method disclosed in the aforementioned U.S. Pat. No. 4,411,709 affords certain benefits over the prior art by eliminating the process of vibrating the sand core from the casting, it still suffers certain disadvantages in that it does not eliminate the requirement for shaking or agitating the casting prior to heat treating, nor does it eliminate the additional processing steps needed to recover the sand for subsequent reuse. The aforementioned patent also does not include an age hardening process for increasing the hardness of the metal. Further, since the method disclosed in the aforementioned U.S. Pat. No. 4,411,709 relies upon force of gravity to remove the sand from the casting, sand will remain on flat and upwardly concave surfaces after the binder has burned off.

SUMMARY OF THE INVENTION

As will be seen, the present invention overcomes these and other disadvantages associated with prior art casting processes. Stated generally, the present invention provides an improved method and apparatus for heat treating metal castings with sand cores which provides for removal of the sand core and recovery of the sand core material for reuse. The method and apparatus of the present invention eliminates the need for chiseling or shaking the casting prior to heat treating, thereby eliminating the possibility of damage associated with those steps. In addition, the present invention recovers the sand in a clean state.

Stated more specifically, the present invention comprises an apparatus for heat treating a metal casting having a sand core comprising sand bound by a binder. A furnace includes a work chamber for receiving the casting therewithin. A heating means heats the work chamber such that the casting and its sand core are heated to a temperature sufficient to combust the binder of the sand core. Thus, the binder is burned off, leaving only the sand of the sand core. The apparatus further includes an airflow means for directing a flow of air over the casting so as to dislodge a portion of the sand from the casting. A means, for example a screen, disposed within the work chamber retains portions of the sand core which may become dislodged from said casting prior to the binder being combusted therefrom. A means operatively associated with the furnace collects the sand which is dislodged from the casting. The sand thus collected is free of binder material and is suitable for reuse.

In another aspect, the apparatus of the present invention comprises a quench tank for containing water into which the heated casting is submerged. The tank includes an agitation means for agitating the water so as to dislodge sand remaining in the casting. A collection means operatively associated with the tank removes the dislodged sand and a portion of the water from the tank and separates a major portion of the water from the sand.

Another aspect of the invention comprises a method for heat treating a metal casting having a sand core comprising sand bound by a binder. The casting with sand core therewithin is heated to a temperature sufficient to combust the binder of the sand core. Thus, the binder is burned off, leaving only the sand of the sand core. Next, a flow of air is directed over the casting so as to dislodge a portion of the sand from the casting. Clumps of sand core material which become dislodged from said casting prior to the binder material being combusted therefrom are captured and retained within the furnace to permit the binder material to be combusted therefrom. The sand dislodged from the casting is then collected, the sand thus collected being free of binder material and suitable for reuse.

Thus, it is an object of the present invention to provide an improved method and apparatus for heat treating metal castings.

It is another object of the present invention to provide an improved method and apparatus for removing the sand cores from metal castings.

Another object of the present invention is to provide a method and apparatus which removes the sand core from a metal casting which minimizes the risk of damage resulting to the casting.

It is a further object of the present invention to provide a method and apparatus for removing the sand core from a metal casting which requires less labor and expense than conventional methods and apparatus.

Yet another object of the present invention is to provide a method and apparatus for removing a sand core from a casting which recovers the core material in a state suitable for reuse, thereby eliminating the need for additional processing of the recovered sand.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
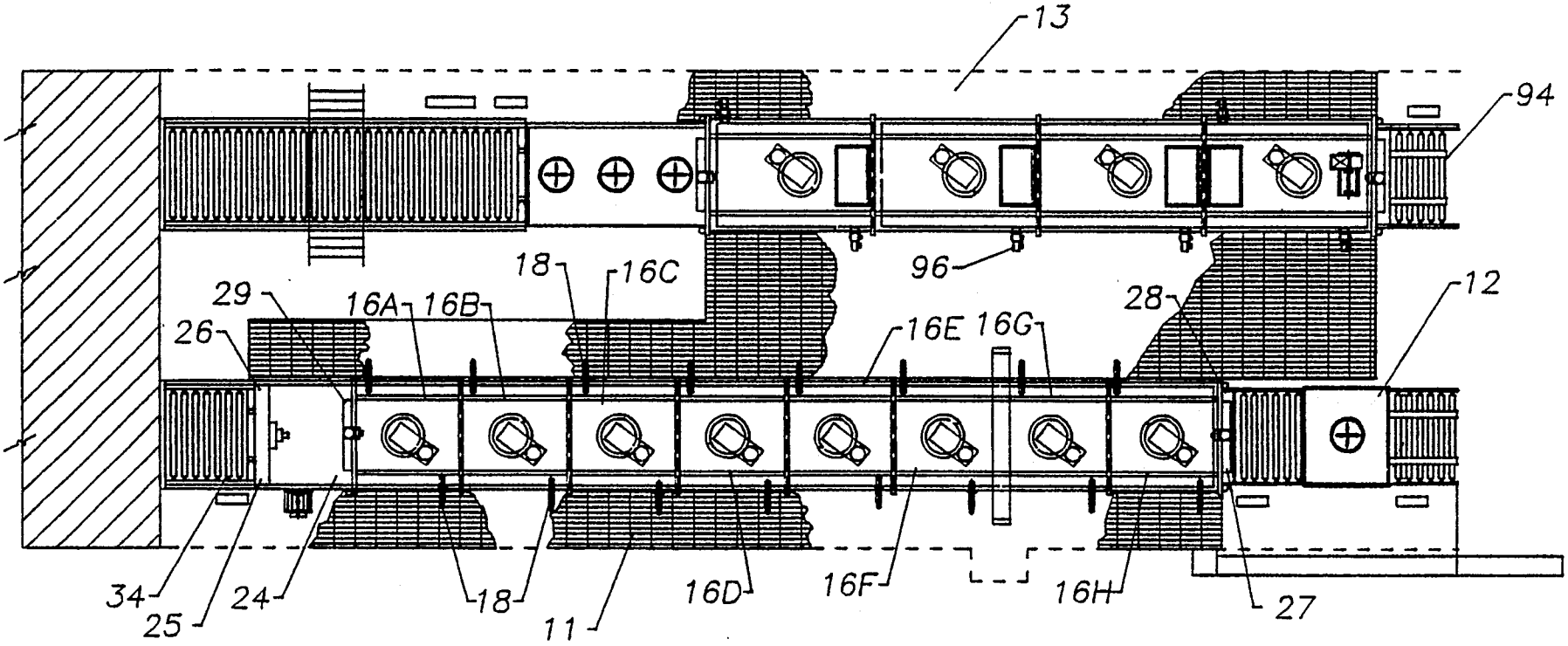
FIG. 1 is a top plan view of a first embodiment of an apparatus for heat treating, quenching, and aging metal castings according to the present invention.

Referring now to the drawings, in which like numerals indicate like elements throughout the several views, FIG. 1 shows an apparatus 10 for heat-treating and aging metal castings according to the present invention. In the disclosed embodiment, the metal castings are cylinder heads which are cast from an aluminum alloy in a conventional manner. The casting process is well known to those skilled in the art and comprises no part of the present invention. Accordingly, the casting process will be described only briefly.

The casting process employs a cast iron flask-type mold having the exterior features of the cylinder head formed on its interior surfaces. A sand core comprised of sand and a suitable binder material and defining the interior features of the casting is placed within the mold. Depending upon the application, the binder may comprise a phenolic resin binder, a phenolic urethane "cold box" binder, or other suitable organic binder material. The mold is then filled with a molten aluminum alloy. When the alloy has solidified, the casting is removed from the mold and is now ready for heat treating and aging.

The heat treating and aging apparatus comprises a heat treating furnace 11, a quench tank 12, and an aging oven 13. In the disclosed embodiment, these three components are laid out in a "U" shaped configuration, with the heat treating furnace 11 comprising one leg of the "U", the quench tank 12 comprising the base of the "U", and the aging oven 13 comprising the other leg of the "U". However, other configurations, such a an in-line configuration or an L-shaped alignment, may be employed as space constraints may dictate.

Figure 2:
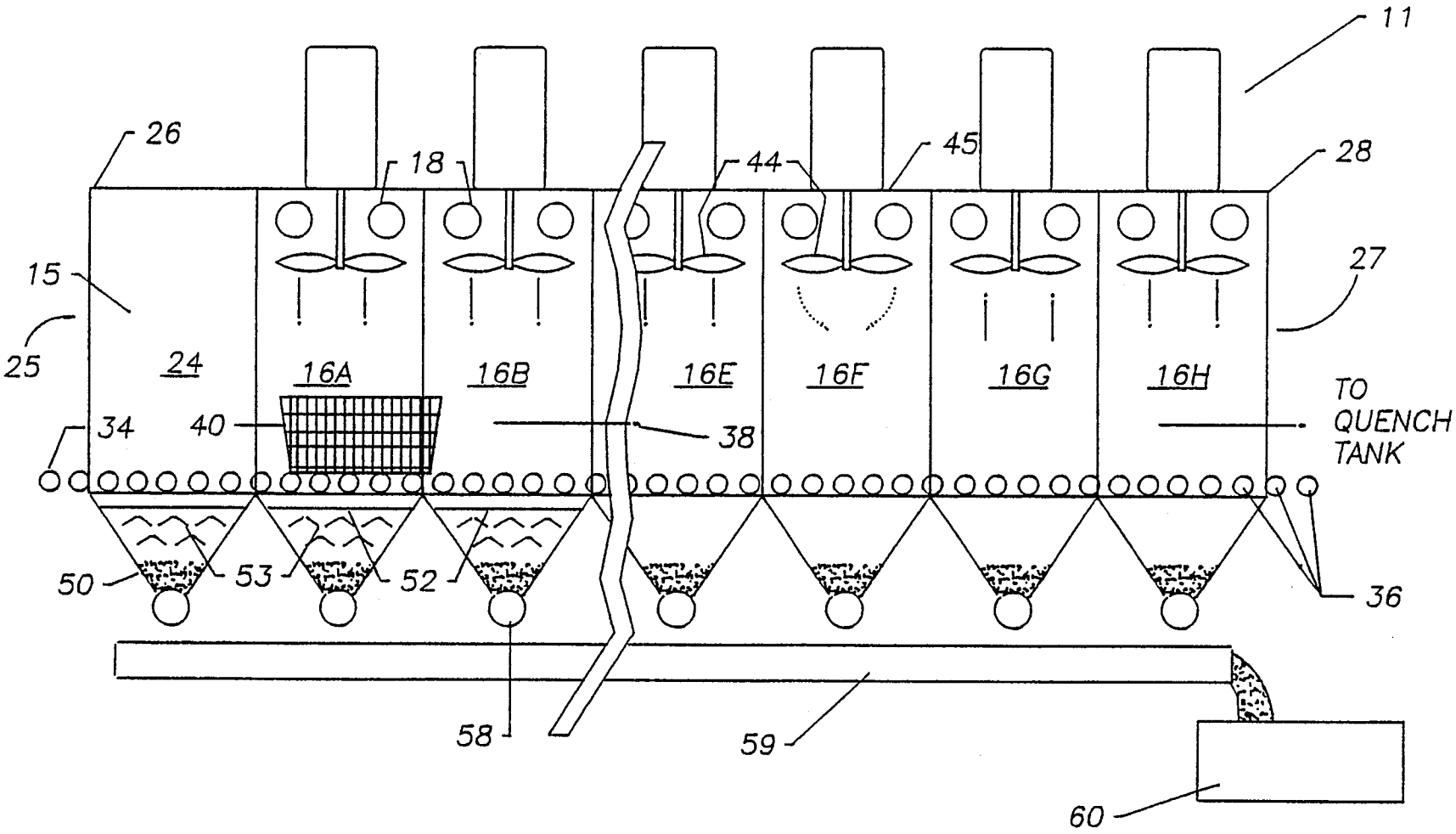
FIG. 2 is a side cut-away view of the heat treating furnace of the apparatus of FIG. 1.
Figure 3:
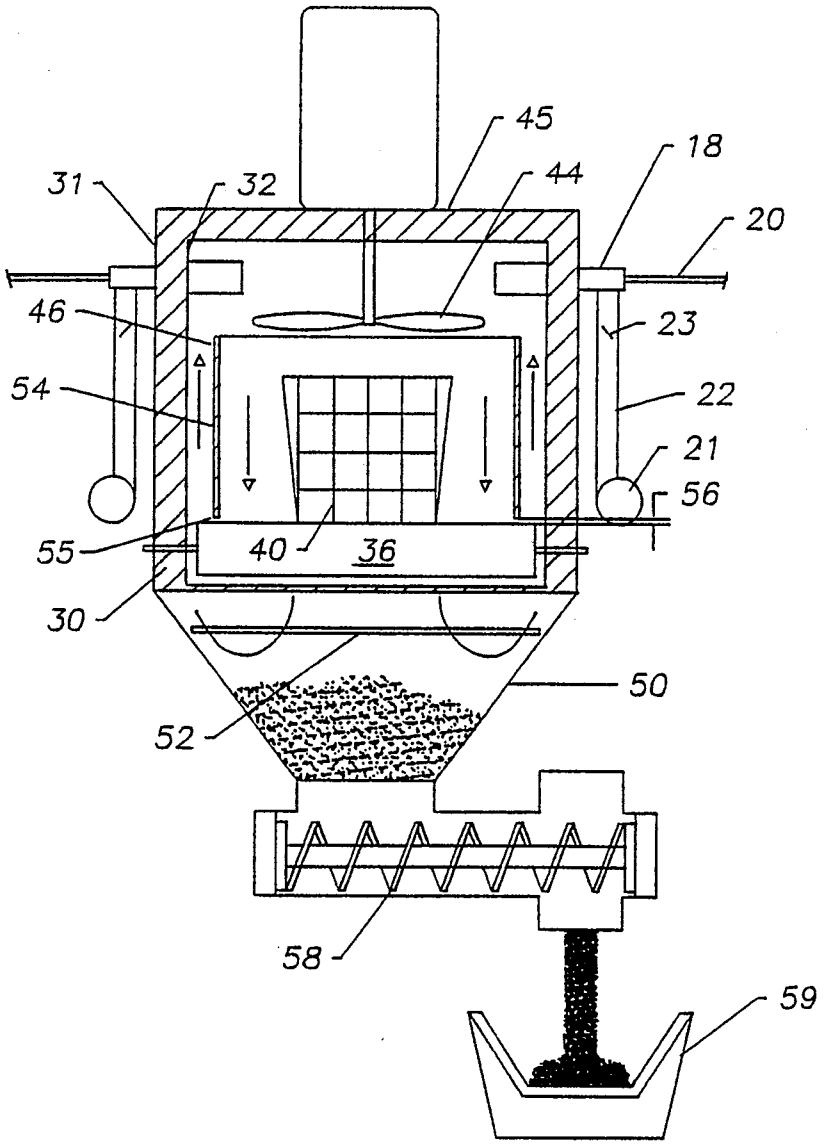
FIG. 3 is an end cut-away view of the heat treating furnace of FIG. 2.

Referring now to FIGS. 2 and 3, the heat treating furnace 11 defines a work chamber 15 therewithin. The furnace 11 comprises a number of different zones 16, the nature and purpose of which will become apparent. In the disclosed embodiment, the furnace comprises eight zones, designated by the reference numerals 16A–H. However, the number of zones 16 is not crucial, and the furnace may be divided into a greater or lesser number of zones as the individual application may require.

Within each zone of the furnace 11, a pair of burners 18 are mounted in the vertical side walls 19 and are diagonally disposed to fire in opposite directions to heat the work chamber 15 of the furnace. The burners 18 are conventional medium velocity, tempered air burners which are commercially available from a number of different manufacturers. As can be seen in FIG. 3, each burner 18 includes a fuel line 20 for supplying natural gas to the burner. A combustion air blower 21 in communication with the burner by means of an air line 22 supplies combustion air to the burner. A butterfly valve 23 located within the air line 22 is adjustable to control the volume of air delivered to the burner 18.

The burners 18 are designed to heat the work chamber 15 of the furnace 11 to a temperature of approximately 850°–1000° F. In the disclosed embodiment, the work chamber 15 is heated to a temperature of approximately 980° F. The butterfly valves 23 for the first zone 16A and the fourth through eighth zones 16D–H are adjusted to introduce 10–13% oxygen to their respective burners 18. The butterfly valves 23 for the second and third zones 16B, 16C are adjusted to introduce 13–17% oxygen to their respective burners 18. The function and purpose of controlling the amount of oxygen delivered to the various zones 16 will be explained below.

The furnace 11 further includes a preheat chamber 24 disposed upline of the heating zones 16. Exhaust gases from the heating zones 16 are directed through the preheat chamber 24 and heat the chamber to a temperature of approximately 500°-700° F. By utilizing waste gases rather than burners to heat the preheat chamber 24, considerable energy savings are realized. The furnace 11 has an input door 25 at its upper end 26 and a discharge door 27 at its lower end 28. Another door 29 separates the preheat chamber 24 from the heating zones 16. To inhibit the loss of heat through the furnace walls, a layer of ceramic fiber insulation 30 is disposed just inside the outer furnace walls 31. A metal liner 32 is disposed on the inner side of the ceramic fiber insulation. The purpose of the metal liner 32 is to protect the insulation 31 from the abrasive effects of flying sand, as will be more fully explained below.

Within the work chamber 15 of the furnace 11 is a roller hearth 34 comprising a plurality of driven rollers 36 for supporting and conveying workpieces through the furnace in a direction of travel indicated by the arrow 38. The roller hearth 34 and drive mechanism for driving the rollers 36 are of conventional design well known to those skilled in the art. At the entry and exit locations of the furnace 11, the roller hearth 34 comprises high speed clutch actuated rollers for transporting the workpieces rapidly into and out of the furnace. In addition, the portion of the roller hearth 34 which transports the workpieces from the preheat chamber 24 into the heating zones 16 of the furnace also comprises high speed, clutch actuated rollers. The major portion of the roller hearth 34 disposed within the furnace 11 is driven at a constant speed.

To facilitate loading of castings into the furnace 11 and transport of the castings through the furnace, the castings are loaded into baskets 40 which, in turn, are loaded onto the roller hearth 34 to be conveyed through the furnace. In the disclosed embodiment, each basket 40 holds forty to fifty workpieces. The baskets 40 are of open construction to permit sand dislodged from the workpieces to fall freely out of the basket. To facilitate removal of the sand from the workpieces, the workpieces may advantageously be angled within the baskets 40 so that the sand will more easily fall out.

With further reference to the roller hearth 34, the speed with which the roller hearth conveys the workpieces through the furnace 11 is a function of the production capacity of the apparatus 10. Thus, in the disclosed embodiment where the furnace 11 must accommodate a new basket of workpieces every thirty-five minutes, the roller hearth 34 must have conveyed the previous basket of workpieces within thirty-five minutes by a distance at least sufficient to permit the next basket of workpieces to be introduced into the furnace. In the disclosed embodiment, based upon the size of the baskets and the production requirements of the apparatus, the roller hearth 34 conveys the workpieces through the furnace 11 at a speed of approximately six feet per hour.

It will be appreciated by those skilled in the art that given the speed of the roller hearth 34, the dwell time, that is, the time for which the workpieces are exposed within the work chamber 15 of the furnace 11, is a function of the length of the furnace. For a roller hearth 34 which moves at six feet per hour, where it is desired to heat treat the workpieces for six hours, the furnace 11 must be at least thirty-six feet in length plus the length of one basket 40 and door end clearance space.

At the vertical center line of each zone, an axial fan 44 is mounted in the top 45 of the furnace 11. The fan 44 circulates the air within the corresponding zone to provide an airflow of 3000-5000 feet per minute. In the first five zones 16A-E of the furnace 11, the fan 44 directs its airflow downward into the work chamber 15 by means of ductwork 46. In the sixth zone 16F, the airflow is directed horizontally over the workpieces by side-flow ductwork (not shown). In the seventh zone 16G, the fan 44 draws air upwardly through the work chamber 15. In the eighth zone 16H, the fan 44 once again directs its airflow downward into the work chamber 15 by means of ductwork 46 in a manner similar to the first five zones 16A-E. The reason for the varying airflow patterns within the various zones 16 will be more fully explained below.

Disposed within the furnace 11 beneath the roller hearth 34 are a plurality of stainless steel troughs 50 whose purpose is to collect sand which falls from the castings within the work chamber 15. The interior walls of the troughs 50 are smooth and are disposed at a 45° angle with respect to horizontal. The walls are sufficiently angled that sand will settle into the bottom of the trough 50 without "bridging." While conventional troughs for handling wet sand typically have walls angled as much as 60°, it will be appreciated that the troughs 50 within the furnace 11 will be handling only extremely dry sand, and walls angled at even less than 45° will collect the sand without permitting the sand to bridge the trough.

A one-quarter inch screen 52 is positioned beneath the roller hearth 34 and over the troughs 50 in each of the first three zones 16A-C. The screens 52 capture particles larger than one-quarter inch which are dislodged from the castings and prevent these larger particles from passing into the trough 50. Any clumps of core material which may become dislodged from the workpieces before the phenolic resin binder fusing the core together has been completely burned off will be retained on the screens 52. The clumps of core material collected on the screens 52 will continue to be exposed to the heat and oxygen-rich airflow within the furnace 11 until the binders have burned off, at which time the clumps will disintegrate. When the clumps have disintegrated to a size smaller than one-quarter inch, the sand will fall through the screens 52.

It has been found that a screen size of smaller than one-quarter inch is not practical, since flashings which are dislodged from the castings will tend to clog a finer screen. Also, while screens 52 may be positioned across the troughs 50 in all of the zones 16A-H if desired, it has been found that by far the greatest risk of clumps of core material becoming dislodged from the castings occurs within the first three zones 16A-C. Thus, in the disclosed embodiment, screens are provided only over the troughs in zones 16A-C, and screens over the troughs in the remaining zones 16D-H are not deemed necessary.

The disclosed embodiment further comprises a plurality of inverted V-shaped baffles 53 disposed over the troughs 50 and beneath the screens 52. Sand passing through the screens 52 will strike the baffles 53 and tumble down the sloped sides of the baffles. Thus, any remaining small clumps of sand will be broken up further before falling into the troughs 50. In the disclosed embodiment, the baffles 53 have upturned flanges at their lower ends which provide structural rigidity to the baffles and also comprise another surface for sand particles to impact before falling into the troughs 50.

Referring in more detail to the ductwork 46 illustrated in FIG. 3, the ductwork includes vertical walls 54 which terminate at a lower end 55. A narrow gap 56 is formed between the lower end 55 of the ductwork 46 and the roller hearth 34. The dimensions of the gap 56 are closely controlled so as not to provide a return airflow path above the roller hearth 34. Instead, the airflow is forced between the rollers 36 and sweeps over the screen 52 and the baffles 53 before returning upwardly outside the vertical walls 54 of the ductwork 46. The importance of this airflow pattern will be explained below.

One end of a screw conveyer or auger 58 is in communication with the bottom of each trough 50 and is adapted to remove the sand which collects in the respective trough. In the disclosed embodiment, it has been determined that the screw conveyers 58 need run only periodically in order to keep the troughs 50 emptied. Because the major portion of the sand will be collected within the troughs in the first three heating zones 16A–C, the augers 58 associated with those troughs run for two minutes out of every fifteen minute period. The remaining screw conveyers 58 run for two minutes out of every twenty-five minute period. All of the screw conveyers 58 empty onto a steel vibratory sand conveyer 59 which comprises a reciprocating steel bed capable of accommodating material as hot as 900° F. without being damaged. The conveyer 59 transports the reclaimed sand to a central collection bin 60 to await reuse.

Figure 4:
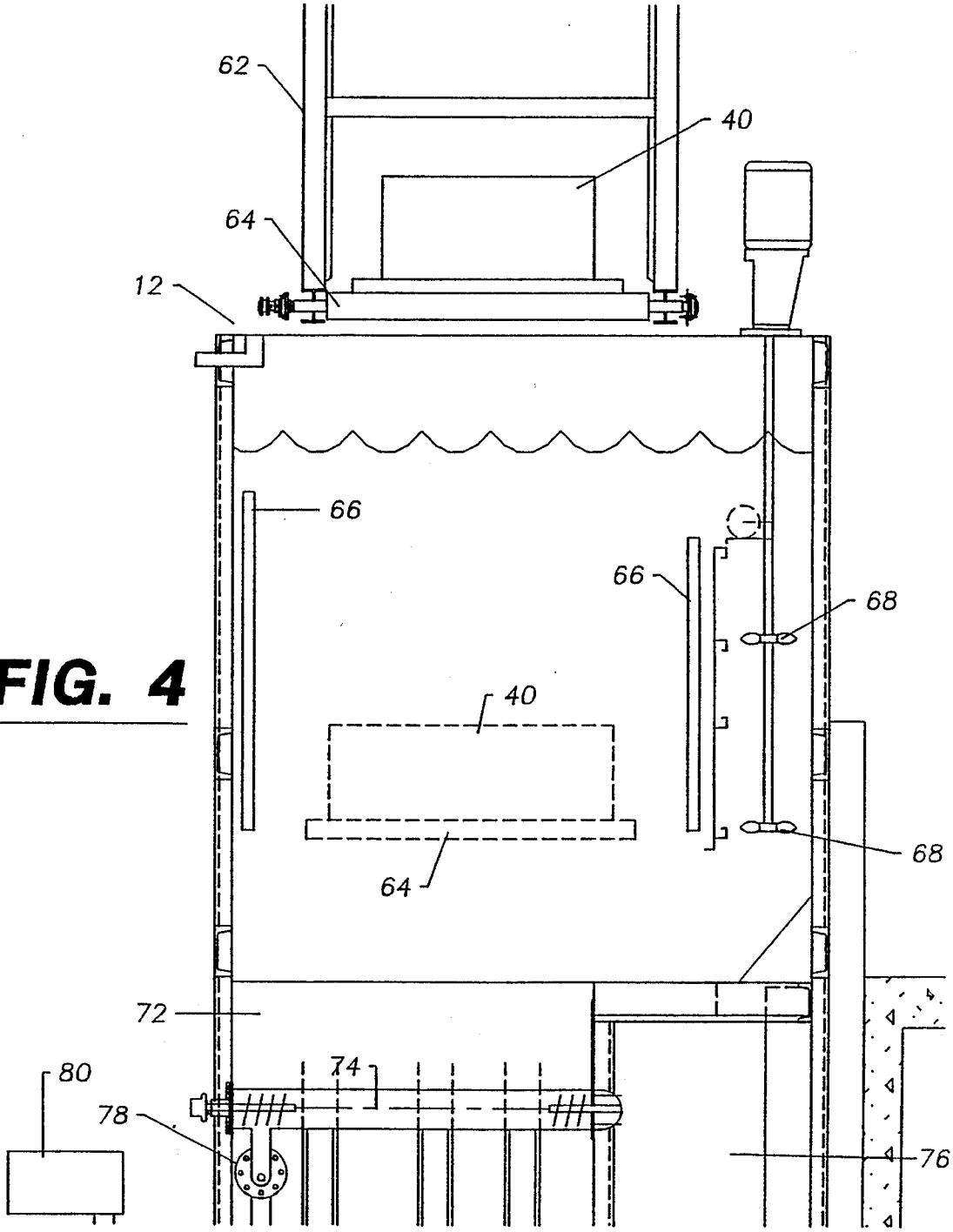
FIG. 4 is a side cut-away view of the quench tank of the apparatus of FIG. 1.

Referring now to FIG. 4, at the downline end of the heat treating furnace is the quench tank 12. The capacity of the quench tank 12 is a function of the size and number of workpieces being immersed at a single time, the specific heat of the alloy comprising the workpieces, and the temperature to which the workpieces have been heated. Preferably, the quench tank 12 should hold sufficient water that the immersion of a load of workpieces into the tank will raise the temperature of the water by no more than 10° F. In the disclosed embodiment, this requirement is met by a quench tank 12 having a capacity of 4,000 gallons of water.

The quench tank 12 includes a conventional rack arrangement 62 for immersing the basket of workpieces in the tank. The rack 62 has a plurality of driven rollers 64 for drawing the workpieces onto the rack. The basket of workpieces is loaded onto the rack 62 while the rack is in its raised position, indicated by the solid lines in FIG. 4. At that point, the roller drive mechanism is disengaged, and the rack 62 with workpieces thereon is lowered into the tank 12 by means of a pneumatic cylinder (not shown) until the basket of workpieces reaches the lowermost position, shown by the dotted lines in FIG. 4. The quench tank 12 is fully automatic and is designed to submerge a load fully within ten seconds after the furnace discharge door 27 begins to open. The quench tank 12 preheats the water to a suitable quench temperature and includes cooling plates 66 to restore the prequenching temperature after each cycle. The quench tank 12 also is provided with twin propeller agitators 68 and direction vanes to agitate the water in the tank. After the workpieces have been submerged for approximately eight minutes, the pneumatic cylinder is actuated to raise the rack 62 and lift the workpieces out of the tank 12. As will be appreciated by those skilled in the art, all of the aforementioned features of the quench tank 12 are conventional.

In addition to the foregoing conventional characteristics, the quench tank 12 includes certain other features for recovering sand which may be loosened from the workpieces during the quenching process. The tank 12 includes a trough 72 within its base such that any sand which becomes dislodged from the castings and settles out of the water will be collected in the bottom of the trough. A watertight screw auger 74 is disposed within the bottom of the trough 72, and the auger communicates with a holding area 76. A double-diaphragm slurry pump 78 is operative to draw material out of the bottom of the holding area 76 and to convey it to a vibratory sand dryer 80. The vibratory sand dryer 80 is of conventional design and therefore is shown in the drawings only schematically. The sand dryer 80 includes a vibrating, rotating 150 mesh screen which permits water but not particulate matter larger than 150 mesh to pass through the screen. Particulate matter too large to pass through the screen openings is vibrated off onto the sand conveyor 59. Water which passes through the screen falls into a collector beneath the screen. The collector in turn is in fluid communication with a 30 gallon holding tank, which is periodically emptied into the quench tank 12.

Figure 5:
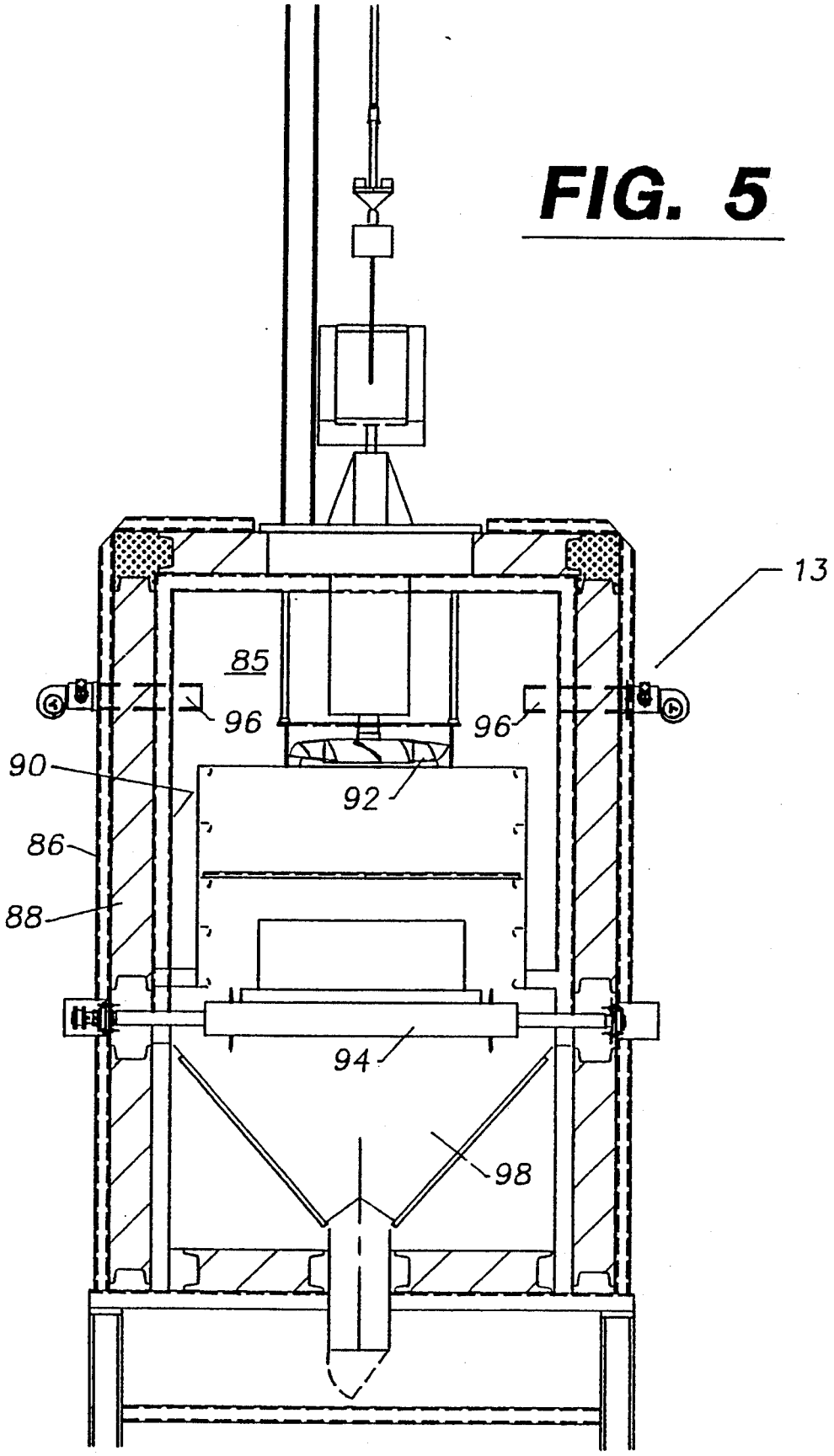
FIG. 5 is an end cut-away view of the aging oven of the apparatus of FIG. 1.

Workpieces removed from the quench tank 12 are introduced into the aging oven 13 for precipitation hardening to increase the hardness of the castings. The aging oven is of conventional design and will therefore be described only briefly. With reference to FIG. 5, the aging oven 13 of the disclosed embodiment is a four zone oven and comprises a work chamber 85. The oven 13 includes outer oven walls 86, an insulating blanket of ceramic fiber 88, and a metal liner 90. A fan 92 located along the longitudinal centerline of the oven 13 circulates heated air throughout the work chamber 85 of the oven. To transport workpieces through the work chamber 85, the oven 13 includes a roller hearth 94 for conveying workpieces through the oven. As is the case with the roller hearth 34 of the furnace 11, the sections of the roller hearth 94 which transport the workpieces into and out of the oven 13 comprise high speed, clutch actuated rollers. The major portion of the roller hearth 94 which is disposed within the oven 13 transports the workpieces at a constant speed. As hereinabove explained with respect to the speed of the roller hearth 34 of the furnace 11, the minimum speed of the roller hearth 94 is determined by the production requirements of the apparatus 10. Given the constraints thus imposed by the minimum required speed of the roller hearth 94, the maximum dwell time of the workpieces within the oven 13 is a function of the length of the oven. In the disclosed embodiment, the dwell time is approximately four hours, though longer ovens for aging periods of up to twenty hours may be desirable, depending upon the alloy used in the casting and the characteristics required of the casting.

The oven 13 includes a number of burners 96 for heating the interior of the oven. In the disclosed embodiment, the burners 96 heat the interior of the oven to a temperature of 450°±5° F. However, depending upon the alloy being aged and the hardness desired, the temperature in the oven may range from 250°–500° F.

The aging oven 13 includes a series of troughs 98 located in its lower portion. However, since the vast majority of the sand is removed during the heat treating and quenching steps, the amount of sand remaining on the workpieces upon their introduction into the aging oven 13 is, at most, minimal. Since so little sand is dislodged within the oven 13, no provision is made for automatically collecting and conveying the sand to a central reclamation location. Instead, the troughs 98 may be emptied at relatively long intervals during routine maintenance of the oven.

The operation of the apparatus 10 will not be described. When the molten aluminum alloy of the castings has solidified, the castings are removed from their respective molds and transferred into one of the baskets 40. Each of the baskets 40 is large enough to hold forty to fifty workpieces and, as previously mentioned, is of open construction to permit sand to pass freely therethrough. To further facilitate removal of the sand from the cavities of the workpieces, the workpieces may advantageously be angled within the basket 40 so that the sand will more easily fall out of the workpieces.

The basket 40 of workpieces is placed on the roller hearth 34 at the upper end 26 of the furnace 11. The input door 25 of the furnace 11 is opened, and the high speed, clutch actuated rollers transport the basket 40 of workpieces into the preheat chamber 24. Exhaust gases from the furnace 11 are directed through the preheat chamber 24 and bring the workpieces up to a temperature of about 380° F. The workpieces are exposed within the preheat chamber 48 until the preceding basket has moved far enough through the furnace to permit introduction of another basket. Thus, in the disclosed embodiment, the workpieces soak in the preheat chamber for approximately thirty-five minutes. When the preceding basket has moved far enough into the furnace to permit another basket to enter, the door 29 between the preheat chamber 24 and the work chamber 15 opens, and high speed, clutch actuated rollers transport the basket 40 into the work chamber.

The natural gas fired burners 18 heat the interior of the furnace 11 to a temperature of approximately 980° F. This temperature is sufficient not only to heat treat the castings but also to burn off the organic binders fusing the core sand together. Thus, as the castings are heated within the work chamber 15 of the furnace 11, the binders are burned off of the sand core material. As the binder burns off, the sand comprising the core loosens. The sand is dislodged from the castings by force of gravity and by the 3000–5000 feet per minute airflow within the furnace generated by the fans 44.

As previously described, the second and third 16B, 16C of the eight zones 16 are provided with 13–17% oxygen, while the remaining zones 16A and 16D–H are provided with only 10–13% oxygen. It has been found that the major portion of such combustion occurs in the second and third zones; in the first zone 16A, the casting and core are being brought up to the combustion temperature of 980° F., and in the later zones 16D–H the combustion has been substantially completed. Further, it has been found that, in those zones where the major portion oft he combustion occurs, combustion of the organic binder material will consume approximately 4–5% oxygen. Accordingly, the burners 18 in zones 16B and 16C are adjusted to provide approximately 4–5% more oxygen than the other zones to compensate for the oxygen consumed by combustion of the binder material and to facilitate the combustion process. In the remaining zones 16A and 16D–F, however, the burners 18 are not adjusted to provide the excessive amount of air required by zones 16B and 16C. Since there is not the excessive amount of air which must be heated, the burners in those zones where less combustion occurs can operate more efficiently than if the higher volume of air were provided to all zones of the furnace.

The workpieces and the sand cores within the workpieces are heated to a temperature of 980° F. over the course of approximately one hour. After the workpieces have reached the "soak" temperature of 980° F., they remain in the furnace for an additional five hours, for six total hours of exposure within the furnace. In other applications, depending upon the alloy used and the metalurgical characteristics desired, the soak time may be as long as twelve hours or as short as four hours.

As the workpieces are conveyed through the first five zones 16A–E, they are subjected to a downward directed flow of turbulent air. As the workpieces pass into the sixth zone 16F, the side-flow ductwork redirects the airflow horizontally over the workpieces. Then, as the workpieces pass into the seventh zone 16G of the furnace 11, they are subjected to an upwardly directed turbulent airflow, caused by the respective one of the fans 44 drawing air upwardly through the work chamber 15. Finally, as the workpieces pass through the eighth zone 16H, the workpieces are again exposed to a downward directed airflow. This succession of downward, sideways, upward, and downward turbulent airflows is successful in dislodging about 85% of the sand from the workpieces.

As will be clear to those skilled in the art, sand particles being blown about inside the furnace by the 3000–5000 feet per minute airflow have a significant potential for abrasion to the interior surfaces of the furnace 11. The metal liner 32 can thus be appreciated for the protection it affords against damage to the furnace's ceramic fiber insulation 31.

The sand dislodged from the castings falls through the basket 40, passes through the spaces between the rollers 36 of the roller hearth 34, falls through the screens 52, strikes the baffles 53, and falls into the troughs 50 beneath the hearth. Any chunks of sand still bound by the organic resin which may become dislodged from the workpieces over the first third of the furnace are captured on the screens 52 over the troughs 50, where they will remain until the heat of the furnace burns off the remaining binder. When the remaining binder is burned off, the clumps of sand will fall apart, and the sand will fall through the screen 52, impact upon the baffles 53 to further break up the clumps, and fall into the trough 50.

The sand which falls into the troughs 50 is conveyed by the screw conveyers 58 to the common sand conveyer 59, whereby it is transported to the collection bin 60 for reuse. It will be appreciated that the sand thus recovered is substantially pure, the organic resin having been burned off during the heat treating process.

As the workpieces exist the lower end 94 of the heat treating furnace 11, they are ready for quenching. The water in the quench tank 12 is preheated to a suitable quenching temperature. The basket 40 of castings is driven onto the rack 62 by the powered rollers 64, and the rack is submerged in the water within ten seconds after the furnace discharge door begins to open. While the workpieces are submerged, the twin propellers 68 agitate the water in the tank, and the direction vanes direct the flow of water over the workpieces. The turbulent water washes any sand remaining in the cavity of the workpieces out of the workpieces and into the tank 12. The workpieces remain submerged for approximately eight minutes, at the end of which time the pneumatic cylinder is actuated to lift the rack 62 out of the tank 12. When the workpieces are removed from the quench tank, substantially all of the remaining sand has been removed from the castings. The castings are now ready for aging.

Meanwhile, the sand which was washed out of the castings in the quench tank 12 settles into the trough 72 in the bottom of the tank. The screw auger 74 conveys the sand-water slurry to the holding are 76, and the double-diaphragm pump 78 moves the slurry onto the vibratory sand unit 80. The water in the slurry passes through the vibrating screen and falls into the collector adjacent to the screen. The water thus separated from the sand is conveyed to the holding tank 82 and from there is returned to the quench tank 12. The sand which remains on top of the vibrating screen is discharged from the screen onto the sand conveyer 59, where it joins sand from the troughs 50 of the furnace 11 in route to the reclamation bin 60.

Upon completion of the quenching process, the workpieces are introduced into the aging oven 13. The burners 96 heat the work chamber 85 of the oven 13 to approximately 450° F. The roller hearth 94 conveys the basket 40 of workpieces slowly through the work chamber 85 of the oven 13 such that the workpieces are subjected to the 450° F. heat of the oven of the disclosed embodiment for a period of about four hours. As previously suggested, the dwell time within the aging oven 13 may range from four to twenty hours, depending upon the particular alloy being used and the metallurgical characteristics desired of the casting. The circulation of the air within the work chamber 85 by the fan 92 facilitates uniform heating of the workpieces. Any sand which becomes dislodged from the workpieces during the aging procedure will settle into the troughs 98 in the bottom of the oven 13. The emergence of the workpieces from the aging oven 13 signals the end of the heat treating and aging process.

As will be appreciated from the foregoing description of the operation of the apparatus 10, a primary feature of the present invention is the combustion of the phenolic resin binding the sand core by exposing the casting and core to the heat of the furnace 11. It has been found that the major portion of such combustion occurs in the second and third of the eight zones; in the first zone 16A, the casting and core are being brought up to combustion temperature of 980° F., and in the later zones 16D–H the combustion is substantially complete. Accordingly, the burners 18 in zones 16B and 16C are adjusted to provide air in excess of the amount required by the burners to ensure that there is sufficient oxygen in those zones to facilitate the combustion process. In the disclosed embodiment, the burners 18 in zones 16B and 16C are adjusted to provide 13–17% oxygen. In the remaining zones 16A and 16D–F, however, the burners 18 are adjusted to provide only 10–13% oxygen. Since there is not the extent of excess air which must be heated, the burners in those zones where less combustion occurs can operate more efficiently than if the same extent of excess air were provided to all zones of the furnace.

The foregoing embodiment has been disclosed with respect to a continuous process, that is, workpieces are continuously being introduced into the apparatus 10, some workpieces thus being in one stage of processing while other workpieces are at other stages of the process. In this continuous process, some workpieces will be undergoing heat treating at the same time that other workpieces are being quenched and still other workpieces are being aged. In fact, at any given time, there may be baskets of workpieces at various points within the furnace 11, some only just beginning the heat treating process while others are further along in the process, all continuously advancing through the apparatus. However, it will be appreciated that the present invention is equally well suited for batch processing, where only a single batch of materials is undergoing processing at any given time.

Figure 6:
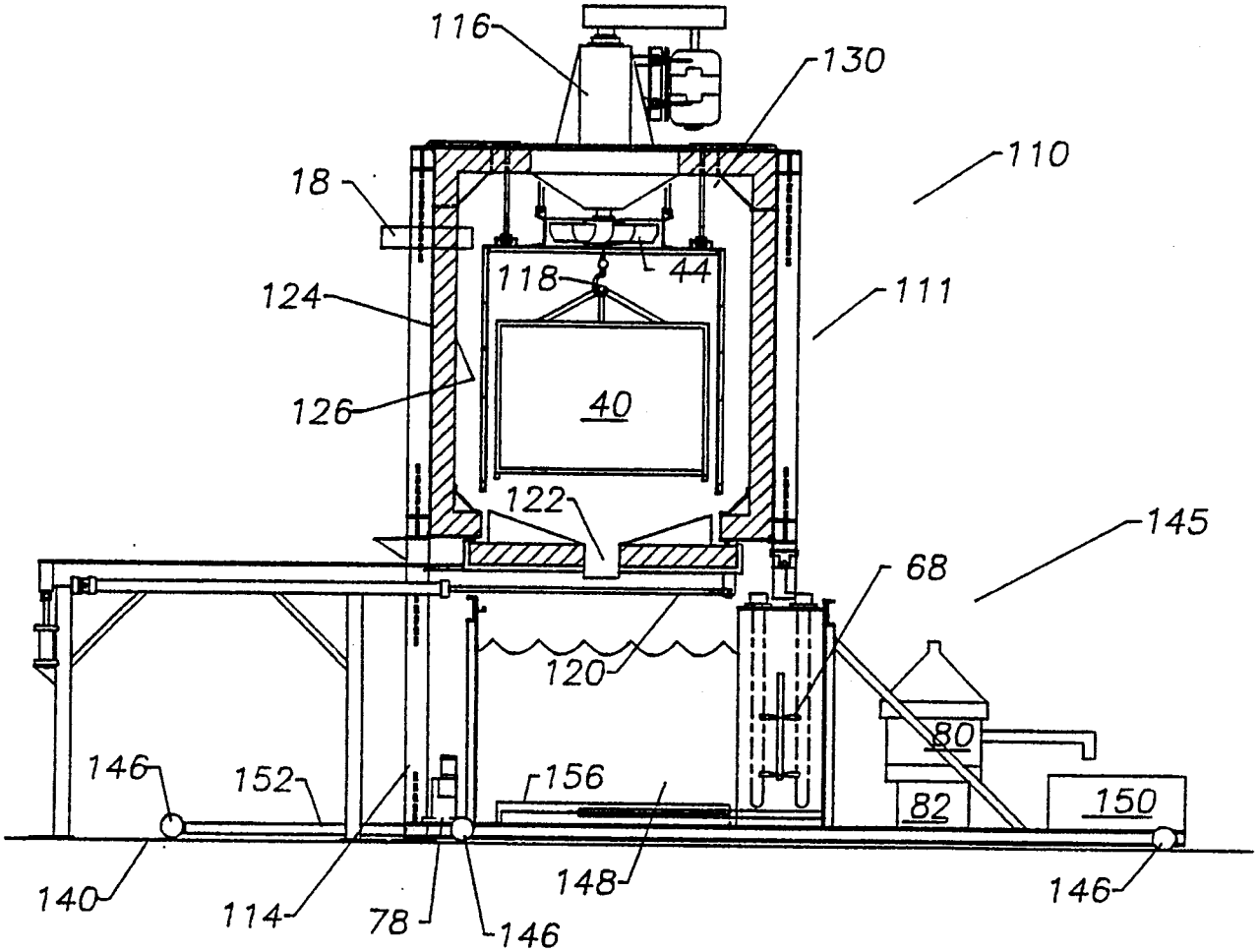
FIG. 6 is a side cut-away view of an alternate embodiment of an apparatus for heat treating, quenching, and aging metal castings according to the present invention.

FIG. 6 discloses a batch-type heat treating apparatus 110 according to the present invention. Certain of the components of the batch apparatus 110 are identical to components previously described and will be designated by the same reference numerals previously used. Thus, components previously described can be recognized from their designation by a reference numeral less than 100. Those components not previously described with reference to the continuous heat treating furnace will be designated with reference numerals higher than 100.

The apparatus 110 includes an elevated drop-bottom furnace 111 elevated on legs 114. A lift mechanism 116 powered by pneumatic, hydraulic, or mechanical power, is operative to raise and lower workpieces into and out of the furnace 111. In the disclosed embodiment, the lift mechanism 116 includes hooks 118 for engaging a basket 40 of workpieces, whereby the entire basket is lifted into the furnace. A sliding door 120 in the bottom of the furnace has a pair of sand collection troughs 122 formed therein. Screens 52 positioned over the troughs 122 prevent particles larger than one-quarter inch from falling into the troughs. Pneumatically operated high temperature slide gates are selectively operable to discharge sand collected in the troughs 122.

As with the continuous furnace 11, the batch furnace 110 has a ceramic fiber insulating blanket 124 to retain heat within the furnace and a metal liner 126 to protect the ceramic fiber insulation from flying sand. A fan 44 mounted in the top of the furnace circulates the air within the furnace at 3000–5000 feet per minute. Burners 18 mounted in the side walls of the furnace 110 heat the work chamber 130 of the furnace. The burners 18 once again comprise means for introducing 120–160% excess air into the burners, with the result that the environment within the furnace comprises 10–12% oxygen.

A pair of tracks 140 runs beneath the elevated furnace 110. A quench tank and transfer car 145 runs along the tracks 140 on wheels 146 and comprises a quench tank 148, a sand collection bin 150, and a basket transfer area 152. The car 145 is selectively operable to position either the basket transfer area 152, the quench tank 148, or the sand collection bin 150 beneath the drop-bottom furnace work chamber 130.

The quench tank 148 includes a heater for preheating the water in the tank to a suitable quenching temperature. A pair of propeller agitators 68 circulate the water in the quench tank. A header 156 in the bottom of the tank has a plurality of openings for placing the interior of the tank in fluid communication with a vibratory sand dryer 80. A double diaphragm pump 78 is selectively operable to pump sand out of the bottom of the quench tank 148 and convey it to the vibratory sand dryer 80. The operation of the vibratory sand dryer has previously been explained. After the water has been removed from the sand by the vibratory sand dryer 80, the water is pumped into a holding tank 82, and the sand is conveyed into the sand bin 150.

The operation of the batch-type furnace 110 will now be explained. Castings are formed as previously described and removed from their respective molds. The castings are placed in a basket 40, and the basket of workpieces is placed on the basket transfer area 152 of the quench tank and transfer car 145. The car 145 is then moved along its tracks 140 to position its basket transfer area 152 directly beneath the heated furnace 111. The bottom door 120 of the furnace is opened, and the lift mechanism 116 is lowered so that the hooks 118 of the lift mechanism engage the basket 40. The lift mechanism 116 is then actuated to raise the basket 40 of workpieces into the work chamber 130 of the furnace 111, and the bottom 120 of the furnace is closed.

The burners 18 heat the load in the work chamber 130 of the furnace 111 to a temperature of approximately 980° F. Again, however, depending upon the alloy used and the metallurgical characteristics desired, the workpieces may be heated over a range of 850°–1000° F. 120–160% excess air is introduced into the burners 18 so that the resulting atmosphere within the furnace comprises 10–12% oxygen. The fans 44 operate to circulate the air within the furnace to achieve an airflow of 3000–5000 feet per minute.

As the castings and the cores are heated, the resin binder begins to burn off. Loosened sand is dislodged from the workpieces by the airflow and by force of gravity, and the dislodged sand falls into the troughs 122. Clumps of core material from which the binder component has not completely burned off will be captured on the screens 52 over the troughs 122 and retained there until the binder has burned off, at which time the unbonded sand will fall through the screen, tumble down the inverted V-shaped baffles 53, and fall into the troughs. The metal liner 126 protects the interior of the furnace 111 from the abrasive effects of flying sand.

When the workpieces have been heat treated for the desired length of time (six hours in the disclosed embodiment), the burners 18 are shut down. The transfer car 145 is positioned along its racks 140 so that the quench tank 148 is directly beneath the work chamber 130 of the furnace 111, and the bottom 120 of the furnace is opened. The lift mechanism 116 is then actuated to lower the basket 40 of workpieces into the quench tank 148. The workpieces are submerged for the desired length of time, during which period the water in the tank is agitated by the twin propellers 68 to loosen the remaining sand from the castings. Sand thus dislodged from the workpieces settles to the bottom of the tank 148. At the end of the quench sequence, the lift mechanism 116 is again actuated to lift the workpieces out of the tank 148. If aging is desired, the furnace 111 is cooled to about 450° F., the basket is again lifted into the work chamber 130, and the furnace door 120 is closed. The workpieces are then aged for the desired length of time.

Upon completion of the quenching sequence, the transfer car 145 is positioned such that the sand collection bin 150 is directly beneath the slide gates of the sand troughs 122. The gates are opened, and the collected sand is discharged from the troughs into the sand collection bin. Again, the sand thus recovered is in a clean, reusable state, all of the binder material having been burned off by the heat of the furnace.

It will be appreciated by those skilled in the art that the provision of a high speed airflow within the work chamber 15 of the furnace 11 will result in abrasive particles of sand being blown about the interior of the furnace at high velocities. The disclosed embodiments therefore include special precautions for preventing excessive abrasion and damage to the interior of the furnace. The interior walls of the furnace, for example, are provided with 11 gauge liners comprised of 4130 alloy to resist abrasion. Also, the fans 44 include features designed to withstand the abrasive environment within the work chambers 15. For example, the blades of the fans 44 are of solid, rather than hollow, construction, as it has been found that flying sand particles can wear holes in hollow blades, especially along seams, and accumulate within the blades. Even a small accumulation of sand within the hollow blades can throw the fan 44 out of balance and cause catastrophic damage to the fan drive mechanism. As another precaution, the leading edges of the blade of the fans 44 are tapered to deflect sand particles.

It will be appreciated that the present invention offers significant advantages over prior art methods and apparatus for processing sand castings. First, the requirement of removing a substantial portion o the core material prior to heat treating the casting has been eliminated. Consequently, the labor, equipment, expense, and risk of damage or scarring to the workpiece associated with manually chiseling out the sand core or subjecting the workpiece to agitation and vibration have been eliminated.

Further, by subjecting the sand core material to the heat and airflow within the furnace, the resin binder fusing the core sand is burned off. To ensure that substantially all of the binder is combusted, the screens 52 prevent chunks of core material larger than a predetermined size from falling out of the furnace and retain such chunks within the work chamber 15 until a sufficient amount of binder has burned off that the chunk can disintegrate and pass through the screen. Chunks of material which are sufficiently small to pass through the screen 52 will impact upon the inverted V-shaped baffles 53 and tumble down the sloped walls of the baffles, further disintegrating the material into its individual particles of sand. Thus, the sand is recovered in a clean, reusable state.

While the recovered sand is clean in the sense that the binder materials have been burned off, the requirements of a particular installation may dictate certain additional processing of the sand before it can be reused. For example, it may be desirable to screen the reclaimed sand to reclassify the sand and to remove any debris which may have become intermixed with the sand.

To facilitate combustion of binder material from chunks of sand retained on the screens 52, the furnace 11 of the disclosed embodiment ensures a continuous airflow of oxygenated air over the screens, as indicated by the arrows in FIG. 3. To accomplish the desired airflow pattern, the dimension of the gap 56 between the lower end 55 of the walls 54 of the duct 46 is kept to a minimum so as not to provide an airflow path around the lower end of the wall and above the roller hearth 34. The air flowing downwardly through the ducts 46 must therefore follow a path downward between the rollers 36 and across the screens 52 before it can return upward between the outer surface of the duct and the liner 32 of the furnace.

A further advantage of the present invention is that since the binder component is combusted, the ecological problems associated with disposal of solid waste material are avoided. If the exhaust gases include an unacceptable quantity of organics or phenils, additional incineration of the exhaust gases may be necessary. In such an instance, the exhaust gases upon exiting the preheat chamber can be delivered to an inline incinerator operating at a temperature of 1400°–1450° F. to incinerate the free organics or phenils.

The control of the oxygen content of the furnace atmosphere in the disclosed embodiment also affords certain advantages with respect to burning off the resin binder. By introducing excess air into the burners in only those zones of the furnace where the major portion o the combustion process occurs, a 10–12% oxygen level within those zones of the furnace is maintained. This level of oxygen facilitates the combustion of the organic resin binder which fuses the core, thereby accelerating the breakdown of the binder and promoting effective combustion of the waste products. However, since the burners in the remaining zones are not adjusted to deliver the extreme amount of excess air required in those zones where the major portion of the combustion process takes place, the burners are able to operate at increased efficiency.

The invention hereinabove described has been disclosed with respect to a furnace utilizing natural gas burners as the heat source. However, it will be understood that the nature of the heating means is not critical, and other types of heating systems, such as propane burners, indirect gas-fired radiant heaters, electric heaters, oil-fired burners, or coal-fired burners, may be employed. It will be appreciated that when indirect gas-fired radiant heaters or electric heat are employed, an air injection system should be used to maintain the oxygen level within the furnace at the desired 10–12% level.

Also, while the disclosed embodiment is an eight zone furnace, the major portion of the binder combustion occurring in the second and third zones, it will be understood that a greater or smaller number of zones may be defined within the furnace. In such an instance, the precise zones within which the major portion of the binder combustion occurs may vary according to a variety of factors, including without limitation the temperature within the furnace, the size and configuration of the castings and cores, the speed at which the castings are moved through the furnace, and the temperature of the castings when they are introduced into the furnace.

Finally, it will be understood that the preferred embodiment has been disclosed by way of example, and that other modification may occur to those skilled in the art without departing from the scope and spirit of the appended claims.

What is claimed is:

1. An apparatus for heat treating a metal casting having a sand core comprising sand bound by a binder, wherein the sand core defines a cavity within the casting, and wherein the apparatus comprises:

a furnace defining a work chamber for receiving the casting therewithin;

a heating means for heating said work chamber such that the casting and the sand core are heated to a temperature sufficient to combust the binder of the sand core, whereby the binder is burned off, leaving the sand of the sand core;

an airflow means for directing a flow of air over the casting while the casting is in said work chamber so as to dislodge a portion of the sand from the casting; and a capturing means operatively associated within said work chamber for capturing portions of the sand core which become dislodged from the casting prior to the binder being combusted therefrom and retaining the captured portions of the sand core within said work chamber until the binder has been substantially combusted therefrom, wherein said capturing means includes, at least, a screen.

2. An apparatus for heat treating a metal casting having a sand core comprising sand bound by a binder, wherein the sand core defines a cavity within the casting, and wherein the apparatus comprises:

a furnace defining a work chamber for receiving the casting therewithin;

a heating means for heating said work chamber such that the casting and the sand core are heated to a temperature sufficient to combust the binder of the sand core, whereby the binder is burned off, leaving the sand of the sand core;

an airflow means for directing a flow of air over the casting while the casting is in said work chamber so as to dislodge a portion of the sand from the casting;

a capturing means operatively associated within said work chamber for, capturing portions of the sand core which become dislodged from the casting prior to the binder being combusted therefrom, and retaining the captured portions of the sand core within said work chamber until the binder has been substantially combusted therefrom; and a baffle means disposed beneath said capturing means for contacting portions of sand core released from said capturing means, wherein said baffle means includes, at least, an inverted V-shaped baffle.

3. An apparatus for heat treating a casting having a sand core comprising sand bound by a binder, wherein the sand core defines a cavity within the casting, and wherein the apparatus comprises:

a furnace defining a work chamber for receiving the casting therewithin;

a heating means for heating said work chamber such that the casting and the sand core are heated to a temperature sufficient to combust the binder of the sand core, whereby binder is burned and portions of the sand core are dislodged from the casting; and suspension means for suspending within said work chamber portions of the sand core dislodged from the casting prior to the binder being combusted therefrom and releasing the suspended portions of the sand core subsequent to the combustion of binder therefrom, wherein said suspension means includes, at least, a screen.

4. An apparatus for heat treating a casting having a sand core comprising sand bound by a binder, wherein the sand core defines a cavity within the casting, and wherein the apparatus comprises:

a furnace defining a work chamber for receiving the casting therewithin;

a heating means for heating said work chamber such that the casting and the sand core are heated to a temperature sufficient to combust the binder of the sand core, whereby binder is burned and portions of the sand core are dislodged from the casting;

suspension means for, suspending within said work chamber portions of the sand core dislodged from the casting prior to the binder being combusted therefrom, and releasing the suspended portions of the sand core subsequent to the combustion of binder therefrom; and baffle means disposed beneath said suspension means for contacting portions of sand core released from said suspension means.

5. The apparatus of claim 4, wherein said baffle means includes, at least, an inverted V-shaped baffle.

* * * * *